United States Patent [19]

Hennemann

[11] 3,936,780

[45] Feb. 3, 1976

[54] SAFETY DEVICE WITH THERMAL AND ELECTROMAGNETIC RELEASE FOR A MULTI-CONTACT CIRCUIT-BREAKER

[75] Inventor: Jean Hennemann, Hombliéres, France

[73] Assignee: UNELEC, Paris, France

[22] Filed: Feb. 12, 1975

[21] Appl. No.: 549,461

[30] Foreign Application Priority Data

Feb. 20, 1974 France ..... 74.05734

[52] U.S. Cl. ..... 335/23; 335/35; 335/44; 335/168

[51] Int. Cl.² ..... H01H 73/48

[58] Field of Search ..... 335/35, 36, 37, 38, 39, 335/40, 41, 43, 44, 167, 168, 8, 9, 10, 14, 21, 22, 25, 23

[56] References Cited

UNITED STATES PATENTS 2,288,270 6/1942 Dorfman et al. ..... 335/25

2,412,294 12/1946 Scott, Jr. ..... 335/168

3,457,531 7/1969 Goodwin, Jr. ..... 335/168

*Primary Examiner*—Harold Broome

*Attorney, Agent, or Firm*—Haseltine, Lake & Waters

[57] ABSTRACT

This device comprises means for detecting, respectively, overcharges, by means of bimetallic strips and short-circuiting, by means of mobile magnetic plates effecting independently from each other the controlling of the switching off of a circuit-breaker for the protection of a circuit. The thermal safety means operate through a mechanical power amplifier comprising a cage with uprights, a rotating catch dependent on the thermal phase-detectors and a plunger transmitting the power of a spring to effect the switching off.

8 Claims, 11 Drawing Figures

SAFETY DEVICE WITH THERMAL AND ELECTROMAGNETIC RELEASE FOR A MULTI-CONTACT CIRCUIT-BREAKER

The present invention concerns a safety device with thermal and electromagnetic release for a multi-contact circuit-breaker comprising detection means respectively for overcharges and for short-circuiting and relates more particularly to the means of embodiment of a structure of the said device retaining the inherent characteristics of the said detectors and the independence of their respective kinetic chains of operation.

In devices known up till now, safety means with respect to both overcharges and short-circuiting which may occur in the electric circuit to be protected actuate, starting with the corresponding detectors of each type, placed on each phase, a switching bar common to all the poles and actuating the control element for the unlocking of the circuit-breaker. That interdependence masks, in actual fact, the kind of defect, overcharge or short-circuiting and does not allow selective operation by the user after switching off.

The progress aimed at by the present invention consists in ensuring the independence of both safety means by organising the kinetic chains of operation of each release so as to make them act separately on the control element of the catch of the circuit-breaker.

One of the characteristics of the invention consists in making the detection means, respectively for the overcharge and for short-circuiting actuate the element for controlling the locking of the circuit-breaker, by independent channels, the means for the thermal detection of overcharge by a shaft common to all the poles and an interposed energy amplifier, those for electromagnetic detection of the short-circuit directly by a switching shaft common to all the poles.

The object and other characteristics of the invention will become apparent in a more concrete way from the description of an example of embodiment having no limiting character, related to the drawing, in which.

Figure 1:
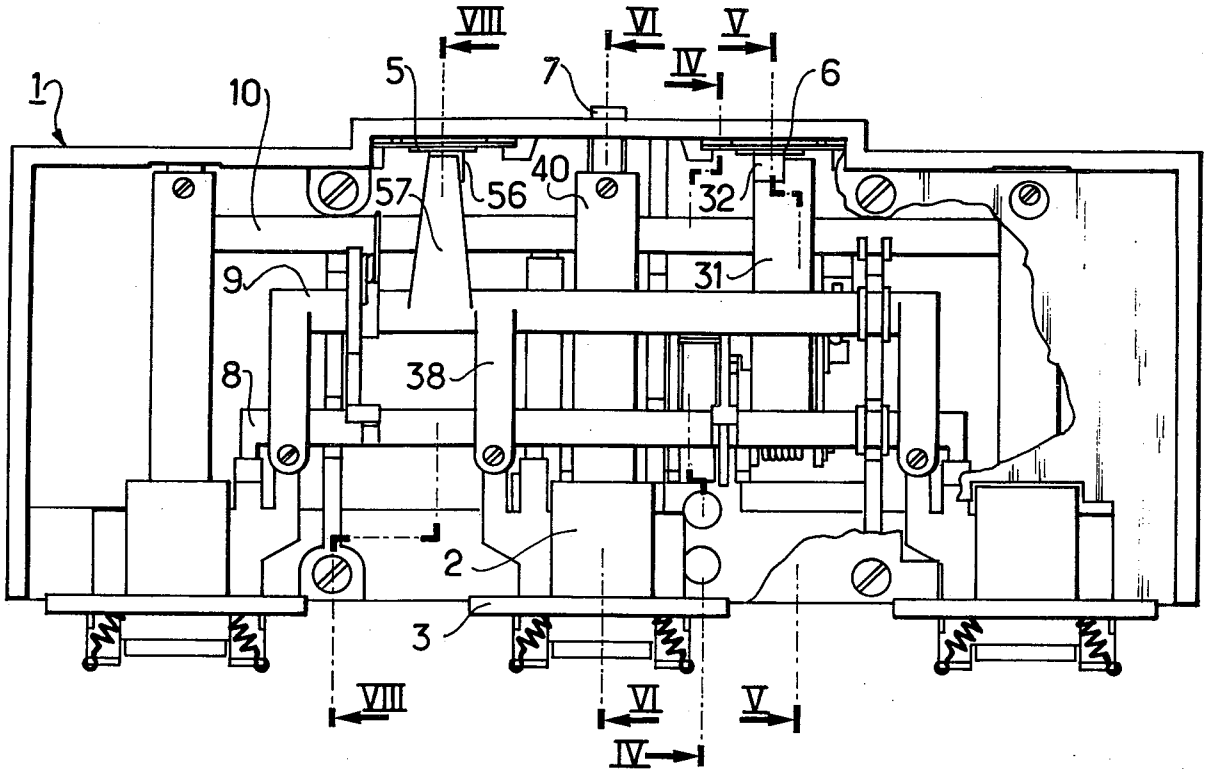
FIGS. 1, 2 and 3 show the safety device according to the invention having several thermal and magnetic releases seen, respectively, from the same side as the mechanism for connecting the detectors to the releases, from the opposite side, that is, at the interface of the circuit-breaker, lastly, from the top, that is, on the same side as the adjusting means available to the user.
Figure 2:
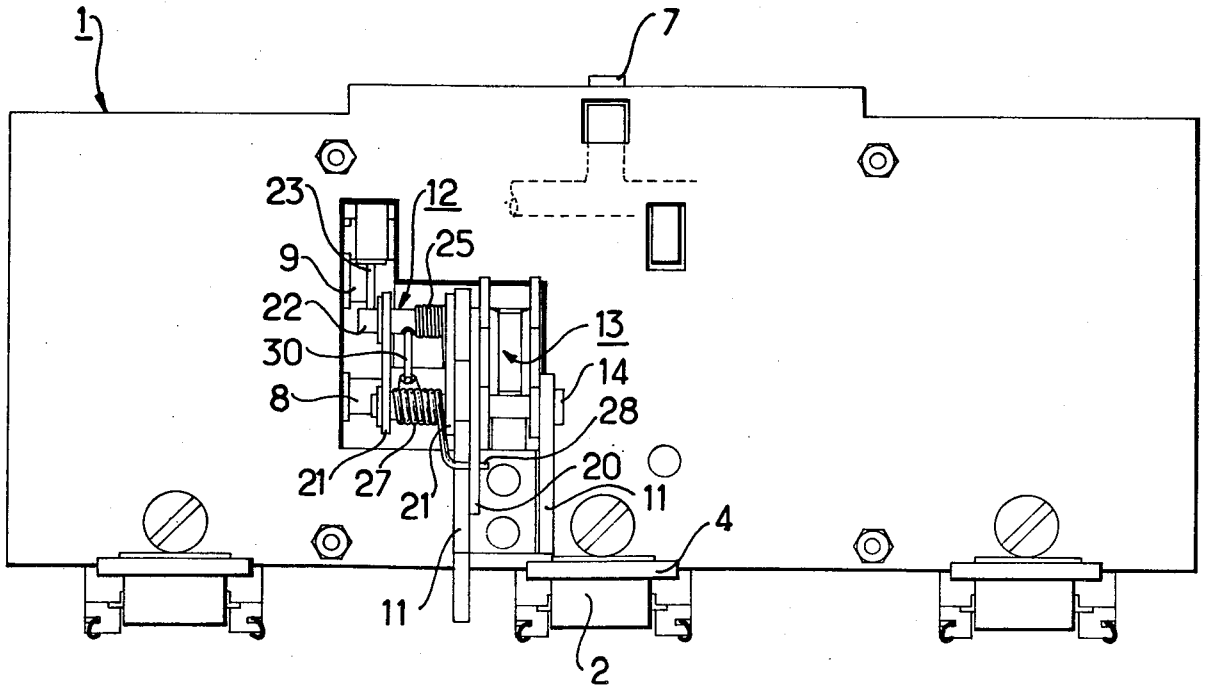
Figure 3:
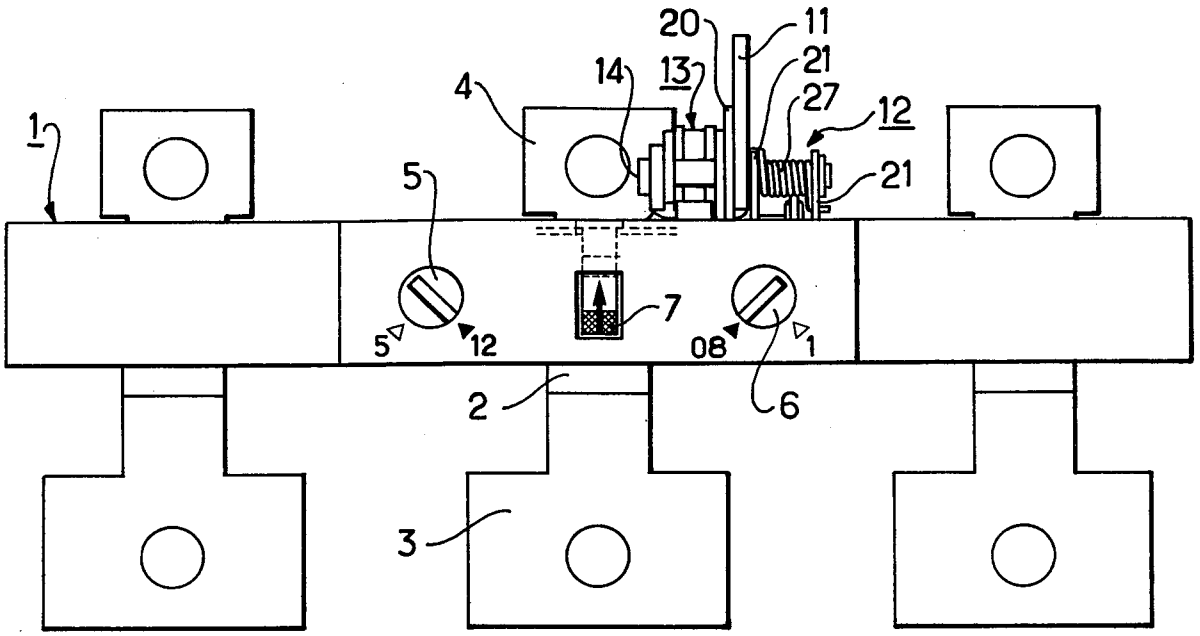

In FIGS. 1, 2 and 3, the parallelepipedic housing 1 of the three-phased safety device comprises, within, the detectors of overcharge and short-circuiting arranged in the vicinity of the conductors 2 crossing right through it. The ends 3 and 4 of the conductor 2 are respectively connected to the electric circuit to be protected and to the theee-phased circuit-breaker related thereto. On the opposite face to the conductors 2, the turning knobs 5 and 6 ensure respectively the collective adjusting of the electromagnetic detectors and the adjusting of the thermal release; whereas the stud 7, slightly protruding, enables simultaneously the manual release of the device and the unlocking of the electromagnetic release shaft 8, when, by way of an extra security means, the locking of the said shaft 8 in the "released" position has been provided for. That shaft, as well as the adjustment bar 9 for the electromagnetic detectors and the auxiliary shaft 10 for the thermal release are parallel to each other and to the longest side of the housing 1. Protruding from the housing 1, on the same side as the interface adjacent to the circuit-breaker and supported by the upreights 11 fixed to the said housing 1, the mechanical amplifier 12 for amplifying the power of the thermal detectors and the device 13 for locking the circuit-breaker are assembled rotating on the common shaft 14 borne by the said uprights 11.

Figure 4:
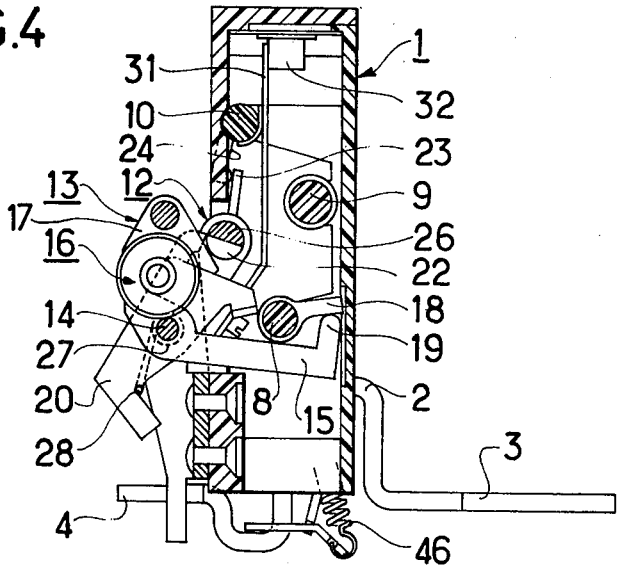
FIGS. 4, 5, 6 and 8 are cross-sections respectively through IV—IV, V—V, VI—VI and VIII—VIII of the device according to FIG. 1.

In FIG. 4, the control lever 15 of the locking device 13 of the circuit-breaker having a locking assembly 16 assembled floating in the yoke 17 is subjected to the independent action: on the one hand, of the shaft 8 for electromagnetic release, whose arm 18 bears on the end 19 of the said lever 15; on the other hand, of the plunger 20 under the dependency of the mechanical amplifier 12.

Figure 5:
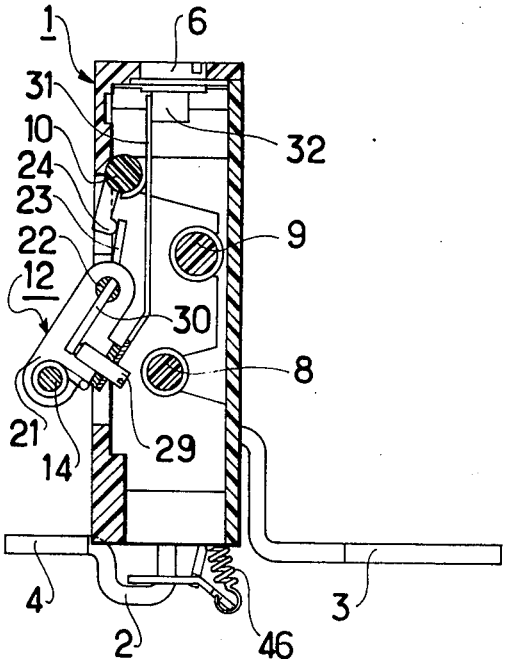

In FIG. 5, the mechanical amplifier 12 comprises a cage having two uprights 21, assembled rotating on the shaft 14 and supporting the rotating catch 22 of the plunger 20 (FIG. 4). The controlling of the catch 22 is effected by a finger 23 fixed to one of its ends situated outside the cage and actuated by the arm 24 of the auxiliary thermal switching shaft 10, the said catch 22 being subjected to the effect of the return spring 25 (FIG. 2) coiled around the said catch 22; whereas at the other end, the semi-circular locking part 26 retains the plunger 20 which exerts on it the strong pressure of the power amplifying spring 27 coiled round the shaft 14 and bearing by its end 28 on the said plunger 20 (FIG. 4).

Figure 7:
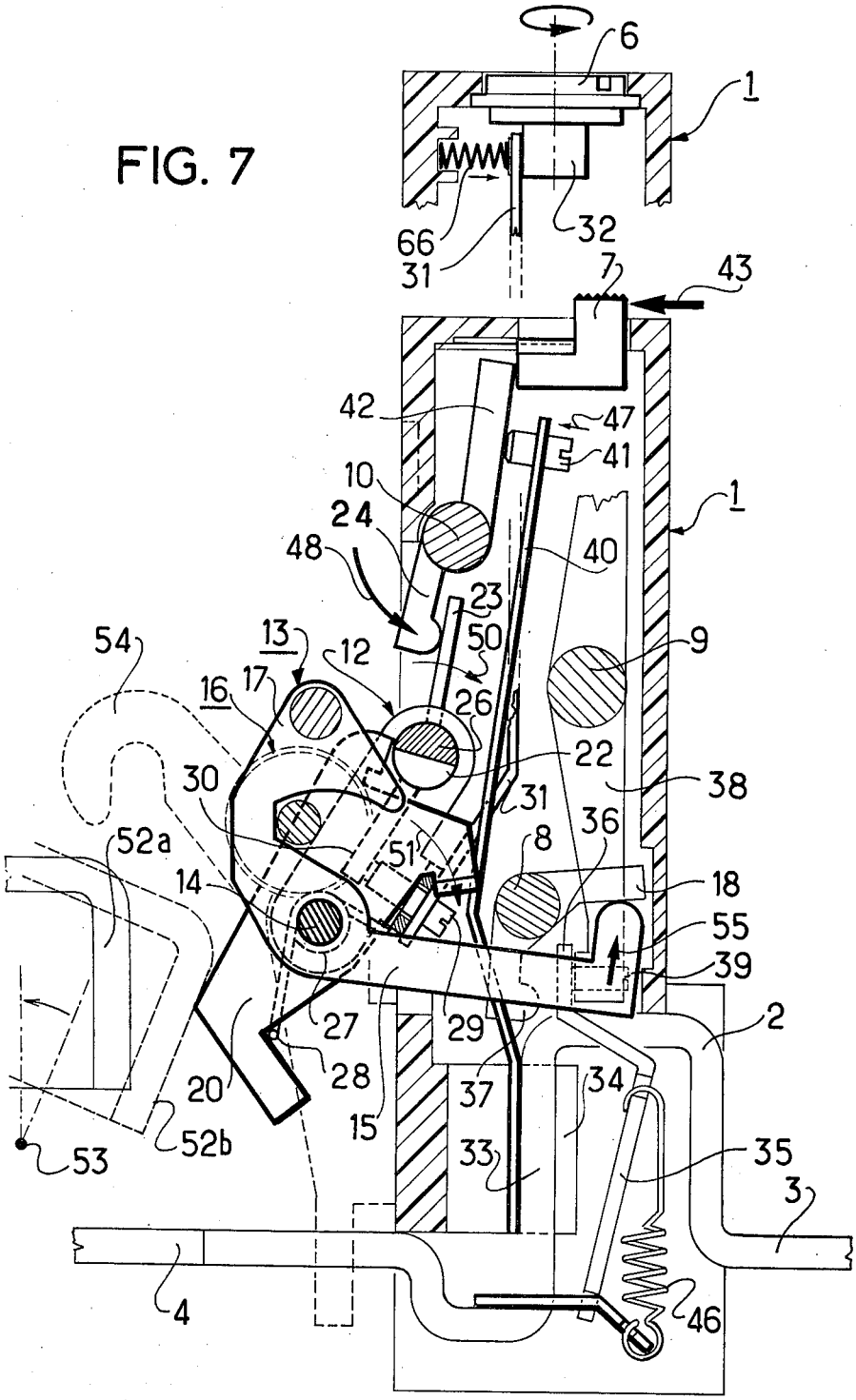
FIG. 7 shows the device having two releases related to the locking element for the circuit-breaker.

On the other hand, during manufacturing, the adjusting of the relative engaging of the plunger 20 and of the rotating catch 22 is effected by the action of the screw 29, assembled on the cage 21, on the finger 30 fixed perpendicular to the axis of the said rotating catch 22; whereas the user can modify the angular position of the amplifier 12 by means of the lever 31 which may be constituted by a compensating bi-metallic strip, assembled on the cage 21 and which is actuated by the cam 32 for adjusting the manoeuvrable release from the outside by means of the knob 6. The lever 31 is applied constantly against the cam 32 by means of the spring 66 (FIG. 7).

Figure 6:
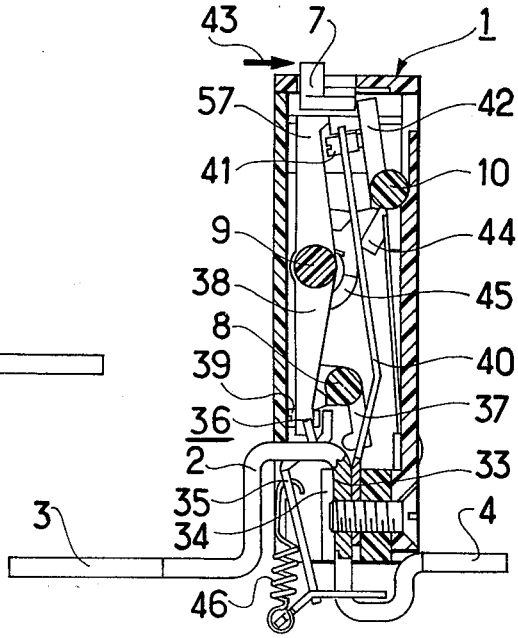

In FIG. 6, the portion 33 of the conductor 2, parallel to the interface of the housing 1 of the device and of the circuit-breaker, is the active portion common simultaneously to the electromagnetic short-circuit detector and to the thermal overcharge detector of each pole. That use of a single part of the circuit 2, to effect the thermal detection and the electromagnetic detection, makes it possible, in connection with the removal, both of the locking device 13 of the circuit-breaker and of the mechanical amplifier 12, to the volume comprised between the interface of the housing 1 of the safety device and of the said circuit-breaker, to reduce (see FIG. 2) the thickness of the said housing 1, to a value substantially lower than that of known devices.

When there is a short-circuit, the current crossing the portion 33 energises the magnetic circuit 34 surrounding the said portion 33 so as to attract the mobile magnetic plate 35 whose end 36 actuates the arm 37 of the electromagnetic switching shaft 8, common to the three poles, whose arm 18 (FIG. 4) actuates the end 19 of the lever arm 15 controlling the switching off of the circuit-breaker by withdrawal of the locking assembly 16.

At the level of each electromagnetic detector, an arm 38 fast with the bar 9 is provided at its end with a screw 39 in contact with the end 36 of the mobile plate 35 retained by the antagonistic spring 46 and enabling the individual adjusting of the air gap of the said detector.

The thermal overcharge detector of each pole comprises the bimetallic strip 40 heated by its base by the portion of conductor 33 with which it is in thermal contact and adjustable by the screw 41 at its other end and in contact with the arm 42 through which it transmits its thermo-mechanical movement to the auxiliary thermal switching shaft 10.

Lastly, by a linear movement in the direction of the arrow 43, the stud 7 actuates the arm 42 to drive in a rotating movement the auxiliary shaft 10 whose arm 44 ensures the unlocking of the shaft 8 by its action on the part 45 assembled to rotate on the cylindrical bar 9 and having caused the locking of the said shaft 8 after a release of the circuit-breaker by the effect of the electromagnetic release.

In FIG. 7, the circuit-breaker being in the switched-on position when there is an overcharge causing excessive heating of the portion 33 of the conductor 2 of a pole, one of the bimetallic strips 40 yields in the direction of the arrow 47 and causes, by means of the corresponding arm 42, the rotating of the auxiliary shaft 10, in the direction of the arrow 48, whose finger 24, fast with the said shaft, drives in the direction of the arrow 50 the finger 23 of the rotating catch 22 whose end portion 26 releases the plunger 20 driven in rotation in the direction of the arrow 51 by the action of the spring 27 of the mechanical amplifier 12, with the power necessary for release by percussion on the control lever 15. The housing 1 of the device is fixed to the circuit-breaker by the part 54 shown in dotted lines, whereas the mobile plate of the said circuit-breaker rotates about the shaft 53. The part of the mobile plate which, after the switching off of the circuit-breaker, is brought, during the switching on again of the said circuit-breaker, into the position ensuring the tripping of the plunger 20 at the same time as the control lever 15 driven in the direction of the arrow 55 by the return spring (not shown) of the locking device 13 is brought back to the start position enabling the switching on of the circuit-breaker, has been shown in dotted lines at 52*b*; whereas in continuous lines at 52*a*, the same part is shown in continuous lines, the circuit-breaker being switched on again.

The stud 7 makes is possible to obtain the manual release of the device: indeed, by an action of the user on the stud 7 in the direction of the arrow 43 (FIG. 6), the latter causes, through the arm 42, the rotating of the auxiliary shaft 10 in the direction of the arrow 48 (FIG. 7), this having the effect of releasing the plunger 20, as previously described. This makes it possible, more particularly, to test the mechanical operation of the device.

Figure 8:
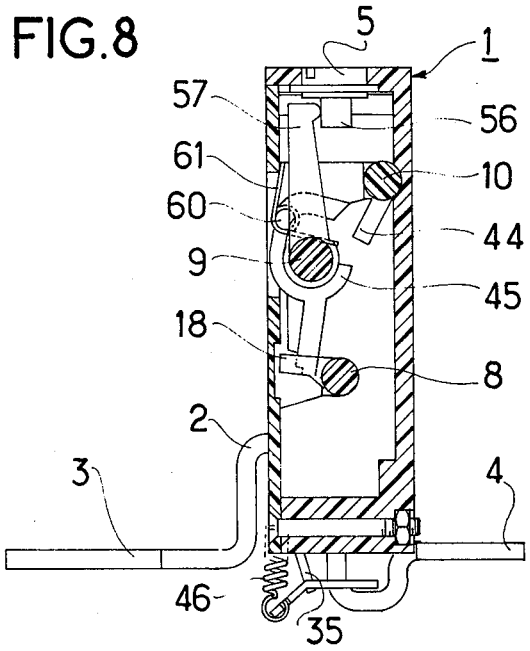

In FIG. 8, the cam 56 driven by the knob enables the adjusting of the electromagnetic release by the user, by means of the arm 57 fast with the bar 9, assembled so as to rotate, for the collective adjusting of the electromagnetic detectors through the arm 38 (FIGS. 1 and 6).

The arm 18 for locking the shaft 8 by means of the part 45 is in the switched on position of the electromagnetic release and consequently is not locked by the said part 45.

Figure 9:
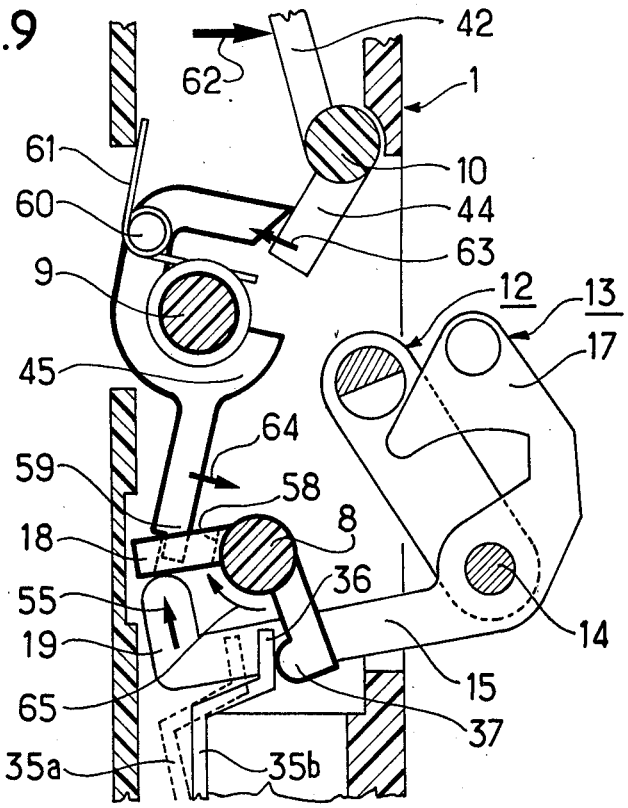
FIG. 9 shows the locking device of the electromagnetic switching shaft in the "released" position.

In FIG. 9, the electromagnetic release having operated, the mobile plate has moved from the position 35*a* in dotted lines, before release, to the position 35*b*, after release and its end 36 has pushed back the arm 37 of the release shaft 8. The locking arm 18, on lowering, has allowed the portion 59 projecting from the locking piece 45 which the spring 61 assembled on the stud 60 of the said piece 45 presses against the wall of the said hollowed out part 58 to keep it in the locked position, to escape from the said hollowed out part 58.

The electromagnetic switching shaft is therefore blocked and it can no longer enable the switching on again without effecting the said switching on again by action on the stud 7 (FIG. 7). Actuating the arm 42 in the direction of the arrow 62. The auxiliary shaft 10 is thus driven so that its arm 44 presses, in the direction of the arrow 63, on the part 45, whose end, moving in the direction of the arrow 64, ensures the withdrawing of the projecting part 59, responsible for the locking of the shaft 8 which, released, is driven in a rotating movement in the direction of the arrow 65 by the action of the end 19 of the control lever 15 in the direction of the arrow 55 on the locking arm 18, or by the action of a return spring, not shown.

That locking of the electromagnetic release shaft in the "switched off" position is a complementary safety feature available for the user who might attempt to effect the switching on again without having checked the disappearance of the short circuit which has caused the electromagnetic switching off.

Inasmuch as concerns the adjusting of the thermal release, this is effected by the choice of the relative engagement surface of the rotating catch and of the plunger actuating the lever controlling the said switching off. Now, the rotating catch being assembled on the cage of the amplifier, it is sufficient to modify the angular position of the said cage to make the said engaging surface vary. For that purpose, the user (FIG. 7) actuates the cage 21 of the amplifier 12 by means of a bimetallic strip for compensating the ambient temperature, fixed by one of its ends on the said cage and having its other end at the user's disposal. Now, the bimetallic strip is subjected to repeated stresses at each "switching on" operation after the release of the circuit-breaker by the effect of one or another of the safety means and it yields under the influence of these stresses, thus causing an uncertain position of the cage at the time of the tripping, that position depending simultaneously on the temperature and the bending of the bimetallic strip.

Nevertheless, it is possible to overcome that disadvantage by arranging the compensation bimetallic strip between the catch of the plunger and the auxiliary shaft which the bimetallic phase strips actuate, whereas the adjusting by the user of the angular position of the cage of the amplifier is effected by a rigid part which is not in danger of yielding at the time of the successive switching on operations.

Figure 10:
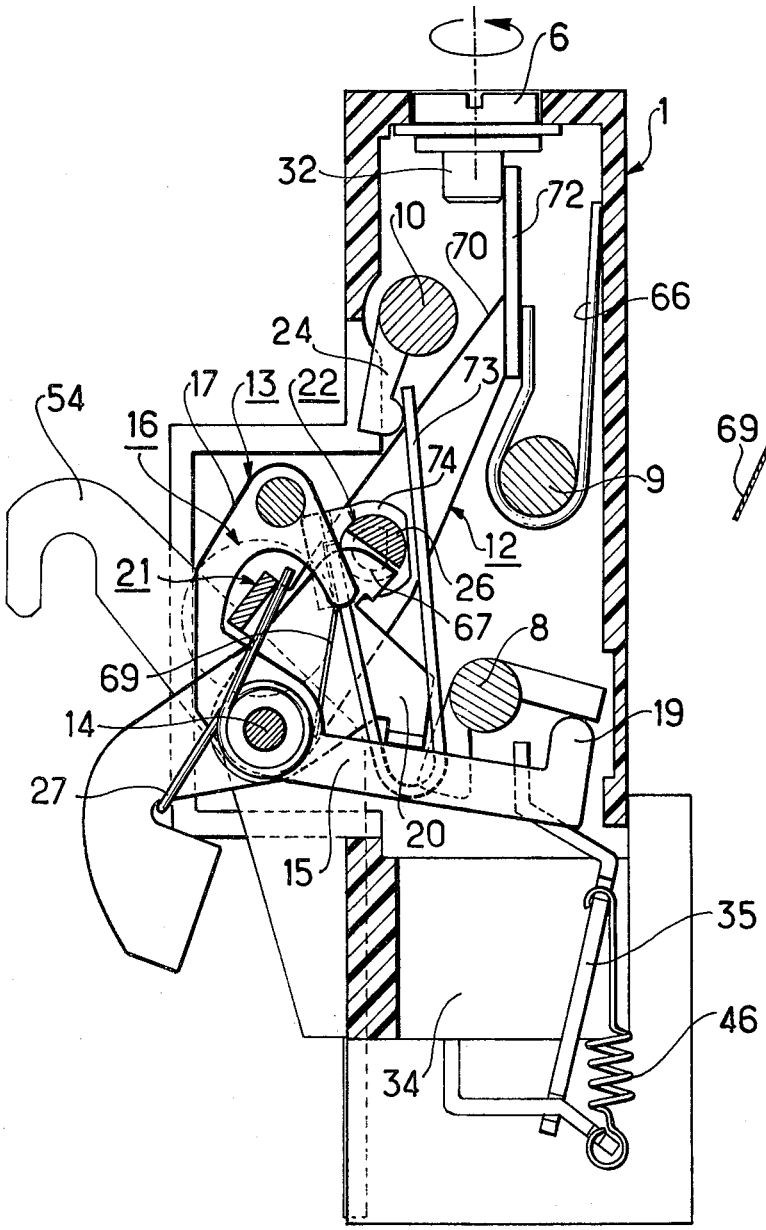
FIG. 10 shows the device having two releasing means, the thermal safety chain comprising a compensating bimetallic strip fast with the catch of the plunger.

According to that variant, in FIG. 10, the auxiliary shaft 10 actuates the bimetallic compensation strip 73 through the finger 24, driving in a rotating movement, the catch 22, whose locking part 26 has retracted to release the plunger 20 which, on striking the control lever 15 of the locking device 13, has enabled the releasing of the circuit-breaker by the retracting of the locking assembly 16 assembled in a floating position in the yoke 17. The mechanical power necessary for the plunger 20 is provided by the spring 27 wound in a spiral round the shaft 14 acting as an axis of rotation for the said plunger 20, the locking device 13 and the cage 21 which has uprights; whereas the said spring 27 is stretched between the plunger 20 and the cage 21.

The adjusting of the angular position of the cage 21 is effected by the user by means of the knob 6 actuating, through the cam 32, the part 72 of one of the uprights 70 of the said cage 21 and held pressed against the said cam 32 by the antagonistic spring 66 assembled in a free position so as to rotate about the shaft 9.

Figure 11:
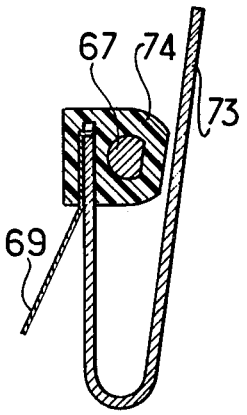
FIG. 11 shows the detail of the fixing of the bimetallic strip in FIG. 10.

In FIG. 11, the compensating bimetallic strip 73 is fixed, at the same time as an antagonistic spring 69, onto the insulating part 74 fitted on the shaft 67 bearing the rotating catch 22 (FIG. 10).

The spring 69 bears by its free end on the spiral part of the spring 27 and thus obliges the catch 22 to assume a definite position by keeping the compensation bimetallic strip 73 pressed against the arm 24 of the shaft 10.

It must be understood that these examples of embodiment have no exhaustive character and that the field which this application is intended to protect corresponds to the general definition which has been given of the invention.

Thus, the locking of the electromagnetic release shaft in the "released" position is an extra safety feature optionally provided for the user and it is sufficient to remove the locking part 45 and its spring 61 (FIG. 9) to cancel the effect of that safety feature if the user wishes to do so. Moreover, in the embodiment described, use is made of the same stud 7 actuating the arm 42 of the shaft 10 either to cause the manual release by the arm 48 of the said shaft 10 by way of testing the device, or to obtain the switching on of the locking device of the shaft 8 by the actuating of the part 45 of the arm 44 of the shaft 10 after an electromagnetic switching off of the device. But it is quite evident that it is possible to obtain the switching on of the locking device of the shaft 8 by equivalent means independent from the manual release mechanism: indeed, for that purpose, by way of example, it is sufficient to use a second stud similar to the stud 7 actuating the lever having two arms similar to the arms 42 and 44, the said lever being installed in a free position and rotating about the shaft 10.

It should be emphasised that this safety device affords, due to the originality of its structure, within a reduced bulk, the same safety as known devices provide in a greater volume and that, moreover, the protection provided is more versatile because of the independence of the kinetic chains comprised between each detector and the circuit-breaker control element.

More particularly, that independence of the kinetic chains allows the same independence of the auxiliary means for indicating release, such as mechanical indicators or indicating contacts which may be actuated either by an arm of the auxiliary thermal release shaft to indicate the release in the case of overcharge, or by an arm of the electromagnetic release shaft to indicate the release in the case of short-circuiting. In the same way, it is possible to use either an arm of the auxiliary thermal release shaft, or an arm of the electromagnetic release shaft for causing the opening of the circuit-breaker by actuating these arms by means of auxiliary release devices, for example of the lack of voltage type. The use, for that purpose, of an arm of the auxiliary release shaft makes it possible to benefit by the use of the mechanical power amplifier and consequently makes it possible to use lower-power auxiliary release means; on the other hand, the use of an arm of the electromagnetic release shaft requires auxiliary release means which are more powerful but make it possible to benefit by the use of the locking system.

I claim:

1. Safety device having a thermal and an electromagnetic release for a multi-pole circuit-breaker comprising means for the detection respectively of overcharge and of short-circuiting actuating, independently from each other, the element for controlling the locking of the said circuit-breaker, characterized in that the said control element (15) is driven respectively directly by an electromagnetic release shaft (8) common to all the poles and which is actuated by the said electromagnetic means (35) for detecting short-circuiting and indirectly through a mechanical power amplifier (12) interposed and controlled by an auxiliary shaft (10) common to all the poles and which are actuated by the said means (40) for the thermal detection of overcharge and in that the said mechanical amplifier (12) comprises a cage (21) having uprights (70); a rotating catch (22) assembled so as to rotate on a shaft transversal to the said cage (21) and which is actuated by the said auxiliary shaft (10), a plunger (20) controlled by the said catch (22) assembled to rotate about a shaft (14) and transmiting the mechanical power of a spring (27) to the said control element (15).

2. Safety device having releases, according to claim 1, characterized in that the plunger (20) and the element (15) for controlling the locking of the circuit-breaker are assembled to rotate about the same shaft (14).

3. Safety device having releases, according to claim 1, characterized in that the cage (21) of the amplifier (12) is assembled to rotate about a shaft (14) and is held, by means of a spring (66) pressing against an adjustable stop (32) and in that the angular position of the said cage takes part in the adjustment of the thermal release means.

4. Safety device having release means, according to claim 3, characterized in that the angular position of the cage (21) of the amplifier (12) depends on a compensation bimetallic strip (31) assembled by one of its ends on the said cage and the position of its other end being adjustable.

5. Safety device having releases, according to claim 1, characterized in that the auxiliary shaft (10) common to all the poles actuates the amplifier (12) through a compensation bimetallic strip (73) assembled fast with the catch (22).

6. Safety device having releases, according to claim 1, characterized in that the devices (13) for locking the circuit-breaker and the mechanical amplifier (12) are contained in the volume comprised at the interface of the housing of the said safety device and of the said circuit-breaker.

7. Safety device having releases, according to claim 1, characterized in that the operation of the electromagnetic release causes, by means of a part (45) assembled to rotate, the locking in the "released" position of the electromagnetic release shaft (8).

8. Safety device having releases, according to claim 7, characterized in that the locking part (45) is assembled to rotate on the bar (9) for adjusting the electromagnetic release.

* * * * *